US007565277B2

(12) United States Patent
Basquet et al.

(10) Patent No.: US 7,565,277 B2
(45) Date of Patent: Jul. 21, 2009

(54) METHOD FOR MODELLING FLUID FLOWS IN A MULTILAYER POROUS MEDIUM CROSSED BY AN UNEVENLY DISTRIBUTED FRACTURE NETWORK

(75) Inventors: Rémy Basquet, La Celle Saint Cloud (FR); Laurent Jeannin, La Celle Saint Cloud (FR); Bernard Bourbiaux, Rueil Malmaison (FR); Sylvain Sarda, Rueil Malmaison (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 1648 days.

(21) Appl. No.: 10/390,654

(22) Filed: Mar. 19, 2003

(65) Prior Publication Data

US 2003/0216898 A1 Nov. 20, 2003

(51) Int. Cl.

| | |
|---|---|
| ***G06G 7/58*** | (2006.01) |
| ***G01V 1/40*** | (2006.01) |
| ***G01V 3/18*** | (2006.01) |
| ***G01V 5/04*** | (2006.01) |
| ***G01V 9/00*** | (2006.01) |

(52) U.S. Cl. ..... 703/10; 702/11; 702/14

(58) Field of Classification Search ..... None
See application file for complete search history.

(56) References Cited

U.S. PATENT DOCUMENTS 5,586,082 A * 12/1996 Anderson et al. ..... 367/73

6,064,944 A * 5/2000 Sarda et al. ..... 702/11

FOREIGN PATENT DOCUMENTS

| | | |
|---|---|---|
| EP | 1158312 | 11/2001 |
| FR | 2787219 | 6/2000 |

OTHER PUBLICATIONS

B. Bourbiaux, S. Granet, P. Landereau, B. Noetinger, S. Sarda, J.C. Sabathier, "Scaling Up Matrix-Fracture Transfers in Dual-Porosity Models: Theory and Application" 1999, Society of Petrolium Engineers, SPE Annual Technical Conference held in Houston Texas, Oct. 3-6, 1999, 15 pages.*

* cited by examiner

*Primary Examiner*—Paul L Rodriguez
*Assistant Examiner*—Dwin M Craig
(74) *Attorney, Agent, or Firm*—Antonelli, Terry, Stout & Kraus, LLP.

(57) ABSTRACT

A method is disclosed for modelling low or high compressibility fluid flows in a multilayer porous medium crossed by a network of fractures of given geometry, unevenly distributed in the medium, some of the fractures communicating with one another. Each fractured layer is defined by means of a grid pattern comprising fracture grid cells centered on nodes either at the fracture intersections or at the fracture ends. Each node is associated with a matrix block including all the points closer thereto than to neighboring nodes, and the local flows between each fracture grid cell and the associated matrix volume are calculated in a pseudosteady state. A modelling equation whose form is similar to the diffusion equation solved in conventional cases (low compressibility fluids) allows accounting for the compressibility of the fluids. The direct flows between the fracture grid cells and the direct flows between the matrix volumes through the common edges of the grid cells are determined, and the interactions between the pressure and flow rate variations that can be observed in at least one well through the medium are simulated.

27 Claims, 4 Drawing Sheets

METHOD FOR MODELLING FLUID FLOWS IN A MULTILAYER POROUS MEDIUM CROSSED BY AN UNEVENLY DISTRIBUTED FRACTURE NETWORK

BACKGROUND OF THE INVENTION

1. Field of the Invention

The present invention relates to a method for modelling low or high compressibility fluid flows in a multilayer porous medium crossed by a network of fractures of given geometry, unevenly distributed in the medium, some of the fractures communicating with one another.

2. Description of the Prior Art a) During oil well testing, the flow rate conditions imposed on the well cause the oil contained in the reservoir to flow towards the well. It is a single-phase (the only mobile phase is the oil) and a low compressibility flow.

For any elementary volume of the reservoir, the pressure of the oil contained in this volume is governed by the following equation (gravity is not taken into account):

$$\phi \cdot C_T \cdot \frac{\partial P}{\partial t} = div\left(\frac{K}{\mu} \cdot \nabla P\right) + Q \tag{1}$$

where:

Φ: represents the pore volume, $C_T$, the total compressibility (fluid+rock),

K, the permeability of the rock,

μ, the viscosity of the fluid,

Q, the incoming flow,

P, the pressure unknown.

b) During gas well testing, the only mobile phase is the gas and it is highly compressible. For any elementary volume of the reservoir, the pressure of the gas contained in this volume is governed by the following equation:

$$\phi \cdot C_T \cdot \frac{\partial \psi}{\partial t} = div\left(\frac{K}{\mu} \cdot \nabla \psi\right) + \frac{2p}{\mu Z} Q \tag{1}$$

where:

Φ: represents the pore volume, $C_T$, the total compressibility (fluid+rock),

K, the permeability of the rock,

μ, the viscosity of the fluid,

Z, the gas compressibility factor,

Q, the incoming flow, and

ψ, a pseudopressure function defined by $$\psi = 2\int_{p_0}^{p} \frac{p}{\mu Z} dp,$$

where p is the pressure of the fluid.

The viscosity and the compressibility factor of the gas vary as a function of the pressure and they are given for a certain number of values in a table referred to as PVT table (Pressure Volume Temperature). From this table, the pseudopressure function defined above can be deduced and the gas compressibility deduced from the equation of state. The PVT table is thus a table with 5 columns (pressure, pseudopressure, viscosity, compressibility factor and gas compressibility) from which, at a given pressure, the corresponding pseudopressure, viscosity and compressibility can be obtained by linear interpolation (conversely, the other 4 data can be obtained by interpolation from a pseudopressure).

The incoming flow Q is zero everywhere, except in the places where the well communicates with the reservoir.

In order to simulate a well test, whatever the medium, this equation has to be solved in space and in time. Definition of the reservoir (grid pattern) is therefore performed and a solution to the problem is finding the pressures of the grid cells in the course of time, itself defined in a certain number of time intervals.

There are known single-phase flow modelling tools, which are however not applied to the real complex geologic medium but to a homogenized representation, according to the reservoir model called double-medium model described for example by Warren and Root in "The Behavior of Naturally Fractured Reservoirs", SPE Journal, September 1963. Any elementary volume of the fractured reservoir is thus modelled in the form of a set of identical parallelepipedic blocks limited by an orthogonal system of continuous uniform fractures oriented in the direction of one of the three main directions of flow (model referred to as "sugar box" model). The fluid flow on the reservoir scale occurs mainly through the fractured medium, and fluid exchanges take place locally between the fractures and the matrix blocks. This representation, which does not reproduce the complexity of the fracture network in a reservoir, is however effective but at the level of a reservoir grid cell whose typical dimensions are 100 m×100 m.

It is however much preferable for reservoir engineers to have a flow simulator based on a "real" geologic model of the medium instead of an equivalent homogeneous model, so as to:

validate the geologic image of the reservoir built by the geologist from all the information gathered on the reservoir fracturation (this validation being performed by comparison with the real well test data), reliably test the sensitivity of the hydraulic behaviour of the medium to the uncertainties on the geologic image of the fractured medium.

A well-known modelling method finely grids the fracture network and the matrix while making no approximation concerning fluid exchanges between the two media. It is however difficult to implement because the often complex geometry of the spaces between the fractures makes it difficult to grid them and, in any case, the number of grid cells to be processed is often very large. The complexity increases still further with a 3D grid pattern.

Techniques for modelling fractured porous media are described in French patents 2,757,947 and 2,757,957 filed by the assignee.

The former technique relates to determination of the equivalent fracture permeability of a fracture network in an underground multilayer medium from a known representation of this network, allowing systematic connection of fractured reservoir characterization models to double-porosity simulators in order to obtain more realistic modelling of a fractured underground geologic structure.

The second technique relates to simplified modelling of a porous heterogeneous geologic medium (such as a reservoir crossed through by an irregular network of fractures for example) in the form of a transposed or equivalent medium so that the transposed medium is equivalent to the original medium, according to a determined type of physical transfer function (known for the transposed medium).

French patent 2,809,494 filed by the assignee describes a method for simulating fluid flows in a fractured porous geologic medium crossed by a network of conducting objects of defined geometry, but which cannot be homogenized on the scale of each grid cell of the model (large fractures, subseismic faults for example, very permeable sedimentary layers, etc.), wherein the exchanges occurring between the matrix medium and the fracture medium are determined, and for modelling the transmissivities of the various grid cells crossed by each conducting object, so that the resulting transmissivity corresponds to the direct transmissivity along each object. In cases where the conducting objects are very permeable sedimentary layers, the transmissivity between the grid cells crossed by each highly permeable layer is given a value that depends on the dimensions of the grid cells and on the common area of contact between the layers at the junction of the adjacent grid cells. In cases where the conducting objects are fractures, the transmissivity between the grid cells crossed by each fracture is given a transmissivity that depends on the dimensions of the grid cells and on the common area of the fracture at the junction of the adjacent grid cells.

French patent 2,787,219 filed by the assignee describes a method for modelling low compressibility fluid (oil) flows in a fractured multilayer porous medium by accounting for the real geometry of the fracture network and of the local exchanges in the porous matrix and between the porous matrix and the fractures at each node of the network. The fractured medium is defined by a grid pattern and the fracture grid cells are associated with nodes placed either at the fracture intersections or at the fracture ends. Each node is associated with a matrix block or volume, the flows between each fracture grid cell and the associated matrix volume are calculated in a pseudosteady state. In cases where the fracture network is weakly connected, that is the fracture network does not run through all of the considered matrix volume, the direct flows between the matrix volumes through the common edges of the grid cells are also determined. Accounting for the transmissivities between matrix blocks associated with medium discretization nodes allows more realistic simulation of the response of a well to imposed flow rate variations.

SUMMARY OF THE INVENTION

The method according to the invention generalizes the technique described in the aforementioned French patent 2,787,219 in cases where the large-scale flows cross not only zones with relatively dense fracture networks but also weakly fractured zones (certain layers for examples), whether low compressibility fluids (oil) or high compressibility fluids (gas).

It comprises the following steps:

a) defining each fractured layer by a grid pattern comprising fracture grid cells that are centered on nodes either at the fracture intersections or at the fracture ends, each node being associated with a matrix block including all points that are closer thereto than to neighbouring nodes;

b) calculating local flows between each fracture grid cell and an associated matrix volume in a pseudosteady state, a transmissivity value being obtained by considering a linear variation of the pressure as a function of the distance between any point of the block and the fracture grid cell;

c) determining direct flows between the fracture grid cells;

d) determining direct flows between the matrix volumes through common edges of the grid cells;

e) determining direct flows between the fracture grid cells and the matrix grid cells on the one hand, and the volume of the well on the other hand; and f) simulating the response of the well for imposed pressure and flow rate variations.

The method according to the invention finds applications notably for oil production. The method allows reservoir engineers to test by simulation the development of a reservoir by one or more wells crossing a permeable porous underground zone comprising two very different media, a matrix medium containing the greatest part of the oil in place and having a low permeability, and additionally conducting fracture networks running partly or entirely therethrough.

If the fluid is highly compressible, the direct flows are determined on one hand between the fracture grid cells and the matrix grid cells, and on another hand the volume of the well, from transmissivity values suited to turbulent flows, and a response of the well is simulated for imposed flow rate variations by means of a modified diffusion equation to account for compressibility of fluid which connects the interactions between the pressure and flow rate variations that can be observed in the well.

According to an embodiment, the diffusion equation is modified by introducing a term depending on the pressure, on the viscosity and on a compressibility factor of the compressible fluid.

According to an embodiment, the direct flows are determined on one hand between the fracture grid cells and the matrix grid cells, and on another hand the volume of the well, by introducing a deviation term proportional to the imposed fluid flow rate.

In order to determine the matrix block associated with each fracture grid cell, each fractured layer is, for example, defined in a set of pixels and a distance from each pixel to the closest fracture grid cell is calculated to determine a location of edges between the grid cells. The calculated distances are used to deduce a value of the transmissivities between each fracture grid cell and a associated matrix volume on the one hand, and between the common edges of the grid cells on another hand.

The position of the edges between the grid cells is, for example, located by displacing two elongate windows in an image formed by the pixels, oriented in two perpendicular directions.

Thus, by taking account of the transmissivities between matrix blocks associated with medium discretization nodes, of the high compressibility when the fluid considered is a gas and by adjusting the transmissivities between the matrix blocks and the well and between the fractures and the well, the response of a gas well to imposed flow rate variations can be realistically simulated.

BRIEF DESCRIPTION OF THE DRAWINGS

Other features and advantages of the method according to the invention will be clear from reading the description hereafter, with reference to the accompanying drawings wherein.

DETAILED DESCRIPTION OF THE PREFERRED EMBODIMENTS

Figure 1:
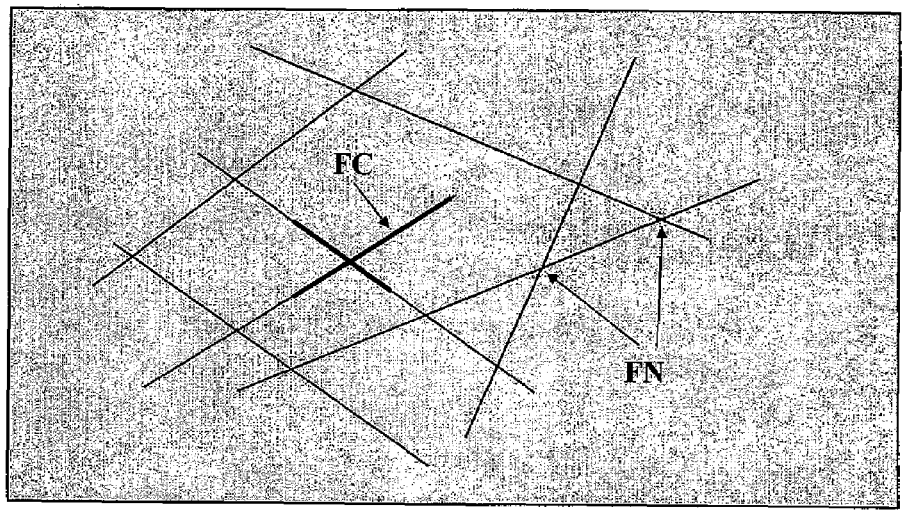
FIG. 1 shows an example of a 2D fracture grid.

In the case of a fractured medium, if all the complexity of the fracture network is to be taken into account, it is necessary to have an explicit grid of this network. Moreover, in such a medium, the permeabilities K are generally much higher in the fractures than in the matrix and the flows are therefore fast in the fractures and slow in the matrix. The fractured medium therefore has to be represented by means of the double medium concept (matrix and fracture) described in the aforementioned French patent 2,787,219. The steps of the approach selected in the case where the fluid produced is oil are as follows:

explicit gridding of the fracture network, association with each fracture grid cell of a single matrix block, processing of the flows between each fracture grid cell and an associated block in a pseudosteady state where the flow from one to the other is proportional to the pressure difference between them, accounting for the flows between matrix blocks, and dynamic simulation of the flows in the fracture network and in the matrix medium.

If the fluid produced is highly compressible, typically a gas, specification or modification as follows occurs:

flow modelling equations of the system are defined so as to obtain a differential equation of the same form as for the low compressibility flows, the terms are defined that describe the fluid flows between the well grid cells and the adjacent fracture grid cell, as well as between the well grid cells and the adjacent matrix grid cell, and dynamic simulation is performed to update during the simulation the viscosity and total compressibility parameters upon each time iteration by means of an interpolation technique, from a PVT data table.

The unknowns are the pressures of the fracture grid cells and the pressures of the associated matrix blocks. Since there are as many matrix blocks as there are fracture grid cells, the number of unknowns is twice this number.

Diffusion Equation

The diffusion equation that is solved is deduced from the mass conservation equation, from Darcy's law and from an equation of state which depends on the compressibility of the mobile fluid. Two different equations of state are considered according to whether the fluid is weakly compressible (oil, case a) or highly compressible (gas, case b).

a) For Weakly Compressible Fluids (Oil)

The equation of state expressing the equivalent compressibility of the mobile fluid (oil) is as follows:

$$c_h = \frac{1}{\rho}\left(\frac{\partial \rho}{\partial p}\right)_T \tag{2}$$

Considering the system of the three equations or law mentioned above (mass conservation and state equations, Darcy's law), for any elementary volume of the reservoir, the pressure of the oil contained in this volume is governed by the following differential equation:

$$\phi \cdot C_T \cdot \frac{\partial P}{\partial t} = div\left(\frac{K}{\mu} \cdot \nabla P\right) + Q \tag{3}$$

where:

Φ: represents the porosity, $C_T$, the total compressibility (fluid+rock),

K, the permeability of the rock,

μ, the viscosity of the fluid,

Q, the incoming flow,

ρ, the density of the fluid,

P, the pressure unknown.

b) For Highly Compressible Fluids (Gas)

In the case of gas, the density, which varies considerably as a function of the pressure, is expressed as follows:

$$\rho = \frac{pM}{ZRT} \tag{4}$$

with M the molar mass of the gas, R perfect gas constant and Z the compressibility factor of the gas which expresses the difference between the real gas and the perfect gases. The compressibility of the gas can thus be expressed as follows:

$$c_g = \frac{1}{p} - \frac{1}{Z}\left(\frac{\partial Z}{\partial p}\right)_T \tag{5}$$

The differential diffusion equation thus becomes:

$$div\left(-\frac{p}{\mu Z} k \overrightarrow{grad}\, p\right) + \Phi \mu C_t \frac{p}{\mu Z}\frac{\partial P}{\partial t} = q\frac{p}{Z} \tag{6}$$

with $C_t$ the global compressibility of a unit element of the saturated porous volume.

In order to obtain the form of a more conventional diffusion equation, this equation is expressed by means of a pseudopressure function defined by:

$$\psi = 2\int_{p_0}^{p} \frac{p}{\mu Z} dp \tag{7}$$

The diffusion equation expressed in pseudopressure is eventually written as $$\frac{\Phi \mu C_t}{k}\frac{\partial \psi}{\partial t} - \Delta\psi = 2\frac{p}{\mu Z}q \tag{8}$$

follows:

The form of the differential equation to be solved is then similar to the form used in the case of low compressibility fluids. The unknown is the pseudopressure ψ (related to the pressure by the PVT table).

Fracture Network Discretization

In 2D, the computing nodes are positioned at the intersections between fractures and at the ends of the fractures. For the purpose of 3D modelling, additional nodes have to be added in the upper and lower layers for fractures running across several layers.

In the grid pattern of the present method, the computing nodes thus defined constitute the center of the fracture grid cells. Furthermore, simulation of highly compressible flows requires knowledge of the volume of the grid cells (ϕ in Equation 8). Grid cell boundaries positioned at the midpoint of the segments connecting the computing nodes are therefore defined. The diagram of FIG. 1 shows an example of a 2D fracture grid cell. In terms of number of computing nodes, gridding of the fracture network is thus optimal.

Fracture-Fracture Transmissivities

The connections between fracture grid cells (transmissivities) used for computation of the flows between these fracture grid cells are computed as described in the method disclosed in the aforementioned French patent 2,757,947.

Matrix Medium Discretization

According to the principle of the method, definition of the matrix medium assigns a rock volume to each fracture grid cell defined as mentioned in the above paragraph. During dynamic simulation, exchanges between the matrix and the fractures are calculated in the pseudosteady state between each fracture grid cell and its associated single matrix block.

For calculation of these matrix volumes, the problem is solved with layer by layer.

For a given layer, the blocks are defined as follows:

the block heights are equal and fixed to the height of the layer, in the plane of the layer, the surface area of the block associated with a fracture grid cell is all the points that are closer to this fracture grid cell than to another one.

Physically, this definition implies that the boundaries at zero flow in the matrix are the equidistance lines between the fracture grid cells.

In order to determine the geometry of the blocks in a given layer, a two-dimensional problem finds, for each fracture grid cell, the points that are closer to this grid cell than to another one has to be solved. This problem is solved by using the geometric method described in the aforementioned French patent 2,047,957.

This method allows, by defining the fractured layer into a set of pixels and by applying an image processing algorithm, to determine a distance from each pixel to a closest fracture. During the initialization phase of this algorithm, value 0 (zero distance) is assigned to the pixels belonging to a fracture and a high value is assigned to the others. Furthermore, if each fracture pixel is given the number of the fracture grid cell to which it belongs in this phase, the same algorithm finally allows determination, for each pixel:

the distance from this pixel to the closest fracture grid cell, and the number of the closest fracture grid cell.

Figure 2:
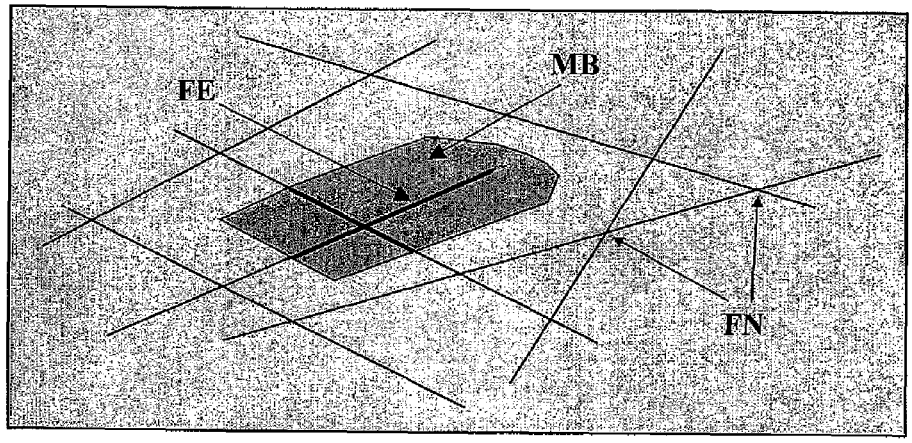
FIG. 2 shows an example of a 2D matrix block.

All of the pixels having the same fracture grid cell number constitute the surface area of the matrix block associated with this grid cell. Multiplying this surface area by the height of the layer allows obtaining the volume of the block associated with the grid cell. FIG. 2 shows an example of a thus obtained 2D matrix block.

By construction, the sum of the surface areas of the blocks is equal to the total surface area of the layer, which guarantees the conservation of the volume of the layer.

Matrix-Fracture Transmissivities

For each matrix block, the image processing algorithm also gives the distance from each pixel of the block to the associated fracture grid cell. This data is used to calculate the transmissivity between the fracture grid cell and the matrix block.

The assumption of a pseudosteady state flow between a fracture grid cell and a matrix block amounts to considering that the flow between the cell and the matrix block is proportional to the difference in the pressures between the cell and the matrix block. The following relation exists:

$$F_{mf} = \frac{T_{mf}}{\mu}\cdot(p_m - p_f) \tag{9}$$

where:

$F_{mf}$ is the matrix-fracture flow, $T_{mf}$, the matrix-fracture transmissivity, μ, the viscosity, $p_m$, the pressure of the matrix block, and $p_f$, the pressure of the associated fracture grid cell.

On the assumption of a pseudosteady state, the value of transmissivity $T_{mf}$ is constant during simulation. In the present method, this value is calculated for each fracture grid cell-matrix block pair.

For this calculation, it is assumed that, in the matrix block, the pressure varies linearly as a function of the distance from the point considered to the fracture grid cell associated with the block. The transmissivity is defined as follows:

$$T_{mf} = \frac{21\cdot H\cdot K}{D} \tag{10}$$

where:

l is the length of the fractures in the fracture grid cell,

H, the height of the layer (and of the matrix block),

K, the permeability of the matrix, and

D, the distance from the fractures for which the pressure is the mean pressure of the block.

l, H and K are known (factor 2 comes from the fact that the fracture has two faces). Calculation of D is made from the information provided by the image processing algorithm concerning the distances from the pixels to the closest fractures. In fact, according to a hypothesis of a linear variation of the pressure as a function of the distance to the fracture, the relationship exists:

$$D = \frac{1}{S} \cdot \int_S d(s) \cdot ds \tag{11}$$

where S is, in 2D, the surface area of the matrix block and d(s) is the function giving the distance between the points of the matrix block and the associated fracture grid cell.

In terms of pixels, the relationship exists:

$$D = \frac{1}{N} \cdot \sum_N d_n \tag{12}$$

where N is the number of pixels of the matrix block and $d_n$ the distance from pixel n to the fracture grid cell.

Matrix-Matrix Transmissivity

Computation of the exchanges between matrix blocks is based on a numerical 2-point flow approximation scheme. This approach implies that the flow between two matrix blocks is perpendicular to the edge between these two blocks. This numerical scheme is therefore generally used for orthogonal and Voronoi grid patterns.

Herein, the matrix blocks have any geometry. Furthermore, the presence of the fractures leads to consideration of two possible geometric cases.

Figure 3:
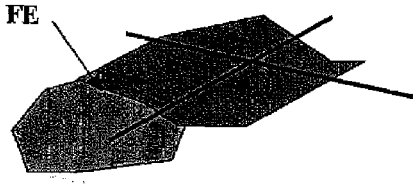
FIG. 3 shows an example of two matrix blocks MB communicating by means of a fracture element FE.

In the first case (FIG. 3), the edge between the two matrix blocks is crossed by a fracture. In the second case, it is not.

Figure 4:
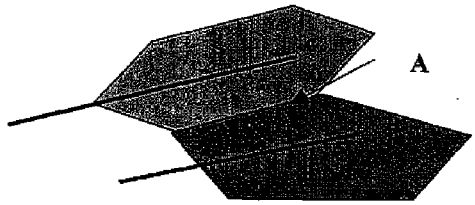
FIG. 4 shows an example of two matrix blocks MB crossed each by a fracture element and communicating by means of exchanges through their common edges A.

In the second case (FIG. 4), it is assumed that, in each of the two fractures of the problem, the pressure can be considered to be constant in relation to the pressure variation in the associated matrix block (because the conductivity of the fracture is very high in relation to the permeability of the matrix). A two-point transmissivity is calculated between the two fracture segments through the edge that separates the two matrix blocks.

This computation is made by means of an image processing algorithm using the digital image defined upon determination of the matrix block geometry, which therefore gives information, for each pixel of the image, about the distance from this pixel to the closest fracture and about the matrix block to which this pixel belongs.

The image processing algorithm locates the elementary interfaces between blocks, i.e. the edges between two pixels associated with two different blocks. The algorithm $$T - k\, H \Sigma \sqrt{p^2 - (di_n - df_n)^2} \tag{13}$$

computes, for each interface, an elementary transmissivity between the two blocks and updates a total transmissivity between these blocks with the formula as follows:

where $T_{mm}$ is the matrix-matrix transmissivity between two matrix blocks, M is the number of elementary interfaces between the two blocks, p is the size of the side of the pixels, and $di_n$ and $df_n$ are the distances from the two ends of interface n to the closest fractures. As can be seen, the total transmissivity is a sum of elementary transmissivities calculated for each interface between the two blocks.

Figure 5:
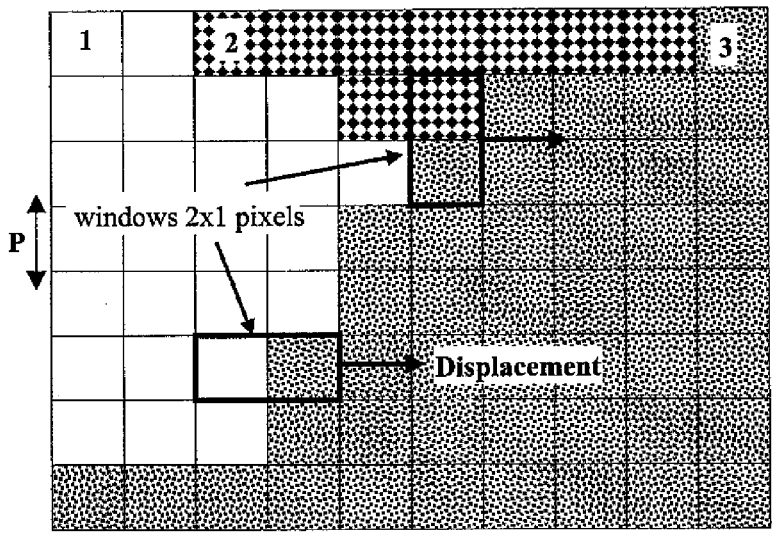
FIG. 5 shows examples of windows oriented along two perpendicular axes, allowing location of the edges between the matrix blocks.

FIG. 5 shows a set of pixels belonging to grid cells 1, 2 and 3. In order to locate the interfaces between the pixels of these grid cells, the image processing algorithm displaces two windows consisting of 2 times 1 pixel along the lines and the columns of the image. There is a vertical window for location of the horizontal interfaces and a horizontal window for location of the vertical interfaces.

In cases where a fracture crosses an edge between two matrix blocks, the transmissivity between these two blocks is simply calculated by means of the expression as follows:

$$T_{mm} k_m \cdot H \cdot \frac{l}{L_{AB}} \tag{14}$$

where l is the length of the edge and $L_{AB}$ the length of the fracture connecting centers A and B. The length of the fracture is known from the construction and the length of the edge is calculated by the image processing algorithm from the elementary interfaces between the matrix blocks of centres A and B.

Well Representation

A well is represented by its geometry on the one hand and by the flow rate constraints imposed thereon with time on the other hand.

Figure 6:
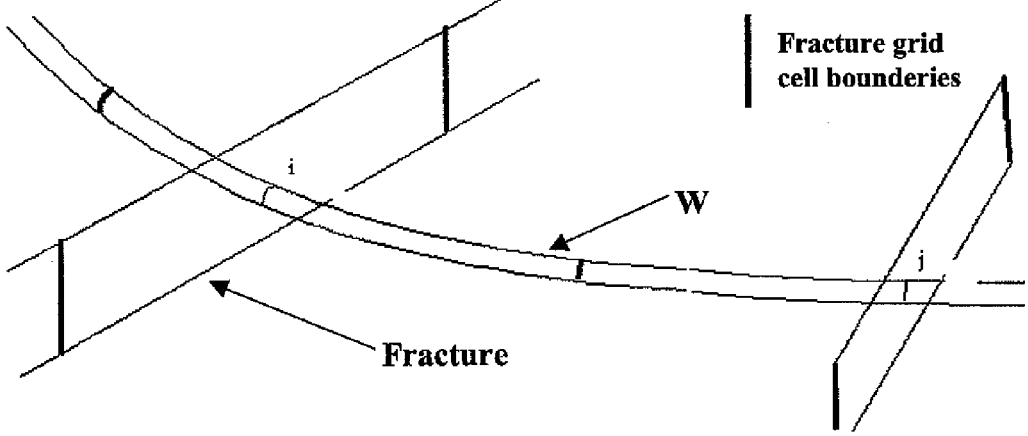
FIG. 6 shows a well W intersected by two fractures.

A well is a series of connected segments that intersect the network fractures (FIG. 6). The geometric representation of a well is therefore a 3D broken line. The points of communication between the well and the network are the points of intersection of this line with the fractures.

Figure 7:
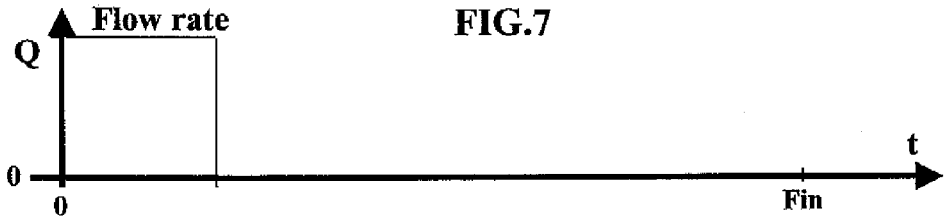
FIG. 7 shows an example of variation, as a function of the time t, of the imposed flow rate D in a well test.

The flow rate constraints are imposed at the point where the well enters the fractured medium. They are entered by the user in the form of a step function giving the flow rate as a function of time. The flow rate change times of the well indicate the various periods to be simulated. For a conventional well test, a flow rate is imposed for a first period after which the well is closed (zero flow rate) and the pressure buildup is observed in the well. The flow rate curve to be given is shown in FIG. 7.

Well-Reservoir Connection a) Fracture-Well Transmissivity

Computation of the exchanges between the well and a fracture is based on the pseudosteady state flow assumption, that is the flow from one to the other is considered to be proportional to the difference in the pressures of one to the other. The following relation exists:

$$F_{pf} = \frac{T_{pf}}{\mu} \cdot (p_p - p_f) \tag{15}$$

with:

$F_{pf}$: the well-fracture flow, $T_{pf}$: the well-fracture transmissivity, $\mu$: the viscosity, $p_p$: the well pressure, $p_r$: the pressure of the associated fracture grid cell.

On the assumption of a pseudosteady state flow, the value of transmissivity $T_{pf}$ is constant during simulation. In the present method, this value is calculated for each fracture grid cell-well segment pair.

Darcy's law, which is used to obtain the differential equation governing the fluid flow in the porous medium, implies that the flow is laminar. In the case of gases and in the neighbourhood of the well, the velocity of the fluid increases greatly so that the flow is no longer laminar (turbulent flow). In this precise case, Darcy's law is not applicable. To overcome this problem, it has been shown that, by introduction of a term referred to as term of deviation from Darcy's law (depending on the imposed flow rate) whose formulation is established for laminar flows, the fluid flow is correctly represented. This term of deviation from Darcy's law is written in the form as follows:

$$S'=S_0+D\cdot Q \tag{16}$$

S' has the dimension of an additional pressure drop, $S_0$ represents the changes in the hydraulic properties around the well (damage during drilling, injection of acids into the well) and coefficient D is a datum characteristic of the turbulent state flow.

In the present approach, the coefficients $S_0$ and D in the expression of the fracture-well transmissivity used for representing the flow between the connected fracture and well are introduced.

If the intersection between a fracture and the well is substantially circular, the transmissivity is defined as follows:

$$T_{pf}=\frac{2\pi C_f}{\ln\left(\frac{2r_0}{d_w}\right)+S_0+D(q_n+q_{n+1})} \tag{17}$$

with:

$r_0=0.14\sqrt{(l_f)^2+(h)^2}$, for isotropic media, $C_f=k_f e_f$, $k_f$ being the intrinsic permeability of the fracture and $e_f$ the opening thereof, $l_f$: the fracture length, h: the thickness of the layer, and $q_n$ the flow rate of the well segment at the flow rate scale n.

In cases where the fracture-well intersection is any intersection (elliptical), the transmissivity calculation is deduced from Peaceman's generalized function, which is well-known in the art.

b) Matrix-Well Transmissivity

Figure 8:
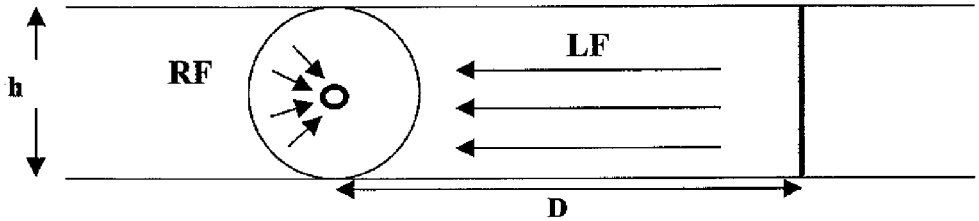
FIG. 8 shows two flow types, a linear flow (LF) and a radial flow (RF), from the matrix to the well.

Computation of the exchanges between the well and an associated matrix grid cell is also based on the pseudosteady state assumption. To express these exchanges, the formulations relative to a radial flow around the well and a linear flow to the well (FIG. 8) are combined. The transmissivity is then defined as follows:

$$T_{mw}=\frac{2\pi k_m l_i}{\ln\left(\frac{2h}{d_w}\right)+\frac{2\pi(l_m-h)}{h}+S_0+Dq_i(t_j)} \tag{18}$$

where:

$l_i$: the length of the well segment, $l_m$: the distance to the well at which the pressure is the mean pressure of the matrix block.

Dynamic Simulation

During dynamic simulation, the simulated period of time is split up into time intervals whose length ranges, for a well test, between $1\times10^{-3}$ s (just after opening or closing of the well) and some hours.

The change from the time n (where all the pressure values are known) to the time n+1 is achieved by solving, in all the grid cells and blocks of the reservoir, the following equation which corresponds to Equation 8 once defined. Unlike the case where the fluid is weakly compressible, the equation which is used is a nonlinear differential equation insofar as the compressibility and the viscosity of the fluid vary as a function of the pressure. The differential equation is written as follows:

$$\phi_i\cdot(C_T)_{\psi_i^{n+1}}\cdot\frac{\psi_i^{n+1}-\psi_i^n}{^{n+1}-t^n}+\sum_j\left(\frac{T_{ij}}{\mu}\right)_{\left(\frac{\psi_i^{n+1}+\psi_j^{n+1}}{2}\right)}\cdot(\psi_i^{n+1}-\psi_j^{n+1})=2\frac{p^n}{\mu^n Z^n}Q_i \tag{19}$$

where:

i, the number of the grid cell or of the block, j, the numbers of the neighbours of i, $\psi^n$: the pseudopressure at the time n, $p^n$, the pressure at the time n, $t^n$, the time at the time n, $(C_T)\psi_i^{n+1}$: the total compressibility of the fluid for a pressure at the time n+1, $$\mu_{\left(\frac{\psi_i^{n+1}+\psi_j^{n+1}}{2}\right)}:$$

the viscosity of the fluid for a pressure at the time n+1 at the interface between grid cells i and j, $Z^n$: the compressibility factor of the fluid for a pressure at the time n, $\mu^n$: the viscosity of the fluid for a pressure at the time n, $Q_i$, the flow entering i at the well bottom, and $T_{ij}$, the connection transmissivity between i and j.

To solve this nonlinear equation, a conventional Newtonian method is used which consists in linearizing Equation (19) by expressing:

$$\psi_i^{n+1,k+1}=\psi_j^{n+1,k}+\delta\psi_i \tag{20}$$

The technique then is based on, upon each iteration k, in solving the linear system described hereafter so that the value of unknown $\delta\psi_i$ becomes negligible. After convergence with k+1 iterations, variable $\psi_i^{n+1}=\psi_i^{n+1,k+1}$ is determined and, by linear interpolation on the PVT table, all the grid cell pressures, the compressibility and the viscosity of the fluid are updated.

Constitution of the System to be Solved

Calculation of the Fracture Grid Cells and Matrix Contribution accumulation term:

$$\frac{\Phi_i \cdot (C_T)_{\psi_i^{n+1,k}} + \Phi_i\left(\frac{dC_T}{d\psi}\right)_{\psi_i^{n+1,k}}\left(\psi_i^{n+1,k} - \psi_i^n\right)}{t^{n+1} - t^n}$$

connection between fracture grid cells:

$$\left(\frac{T_{i,j}}{\mu}\right)_{\left(\frac{\psi_i^{n+1,k}+\psi_j^{n+1,k}}{2}\right)}\left(1 - \left(\frac{1}{\mu}\frac{d\mu}{d\psi}\right)_{\left(\frac{\psi_i^{n+1,k}+\psi_j^{n+1,k}}{2}\right)}\left(\frac{\psi_i^{n+1,k} - \psi_j^{n+1,k}}{2}\right)\right)$$

second member of the system:

$$2\left(\frac{p}{\mu Z}\right)_{\psi_i^n} Q_i - (\Phi_i(C_T)_{\psi_i^{n+1,k}}\left(\frac{\psi_i^{n+1,k} - \psi_i^n}{t^{n+1} - t^n}\right) - \sum_j \left(\frac{T_{ij}}{\mu}\right)_{\left(\frac{\psi_i^{n+1,k}+\psi_j^{n+1,k}}{2}\right)}(\psi_i^{n+1,k} - \psi_j^{n+1,k}))$$

Solution of the Linear System

Solution by means of the iterative conjugate gradient algorithm (CGS) which is well-known in the art, with updating of the pressures of the fracture grid cells and of the matrix blocks.

Time Interval Management

During well test simulation, the time intervals are generally very short after opening or closing of the well, because the pressure variations are high at these times. Later, the time intervals can be longer when the pressure variations are lower.

Management of the time intervals connects the length of the time interval n+1 to the maximum pressure variation observed during time interval n. The user must therefore provide the following data:

Initial time interval: $dt_{ini}$

Minimum time interval: $dt_{min}$

Maximum time interval $dt_{max}$

Lower limit of pressure variation: $dp_{min}$

Upper limit of pressure variation: $dp_{max}$

Time interval increase factor: rdt+(>1)

Time interval reduction factor: rdt−(<1).

From these values, management of the time interval is performed as follows:

At the time $t^n$, the majorant of the pressure variations in the fracture grid cells and the matrix blocks is calculated (i.e. between times $t^{n-1}$ and $t^n$). According to the value of this pressure variation dp, the time interval is either:

increased by a factor rdt+ if $dp<dp_{min}$, decreased by a factor rdt− if $dp>dp_{max}$, unchanged in the other cases.

After each bottomhole flow rate condition change, the time interval is re-initialized to the value $dt_{ini}$. Furthermore, an optimization is performed at the end of the simulation period: if tf is the time to be simulated to reach the end of the period and dt the planned time interval, the time interval selected is min(tf/2,dt).

Simulation Input Data

The geometry of the fracture network and the attributes of the fractures (conductivity, opening) are given in a file whose format is defined in the aforementioned French patent 2,757,947.

The petrophysical data to be provided are as follows (the unit is given between parentheses):

compressibility of the fracture network ($c_f$ in $bar^{-1}$)

compressibility of the matrix ($c_m$ in $bar^{-1}$)

matrix permeability (K in mD)

matrix porosity ($\Phi_m$ dimensionless).

The data in question are considered to be homogeneous on the fractured medium considered.

The data relative to the fluids contained in the fractured medium concern the gas (mobile) and the water (immobile) that is always present in residual amounts in the matrix:

residual water saturation in the matrix (Sw dimensionless)

compressibility of the water ($c_w$ in $bar^{-1}$)

a PVT table comprising the compressibility factor of the gas (Z) and the viscosity of the gas (μ in cpo) as a function of the pressure.

The data relative to the well are:

its geometry, in the form of a series of connected segments the imposed flow rates, in the form of a curve giving the imposed flow rate as a function of time the damage coefficient $S_0$ of the formation around the well, and the coefficient D of deviation from Darcy's law.

The values to be provided are the values already defined in the chapter relative to the time interval management: $dt_{ini}$, $dt_{min}$, $dt_{max}$, $dp_{min}$, $dp_{max}$, rdt+ and rdt−.

Figure 9:
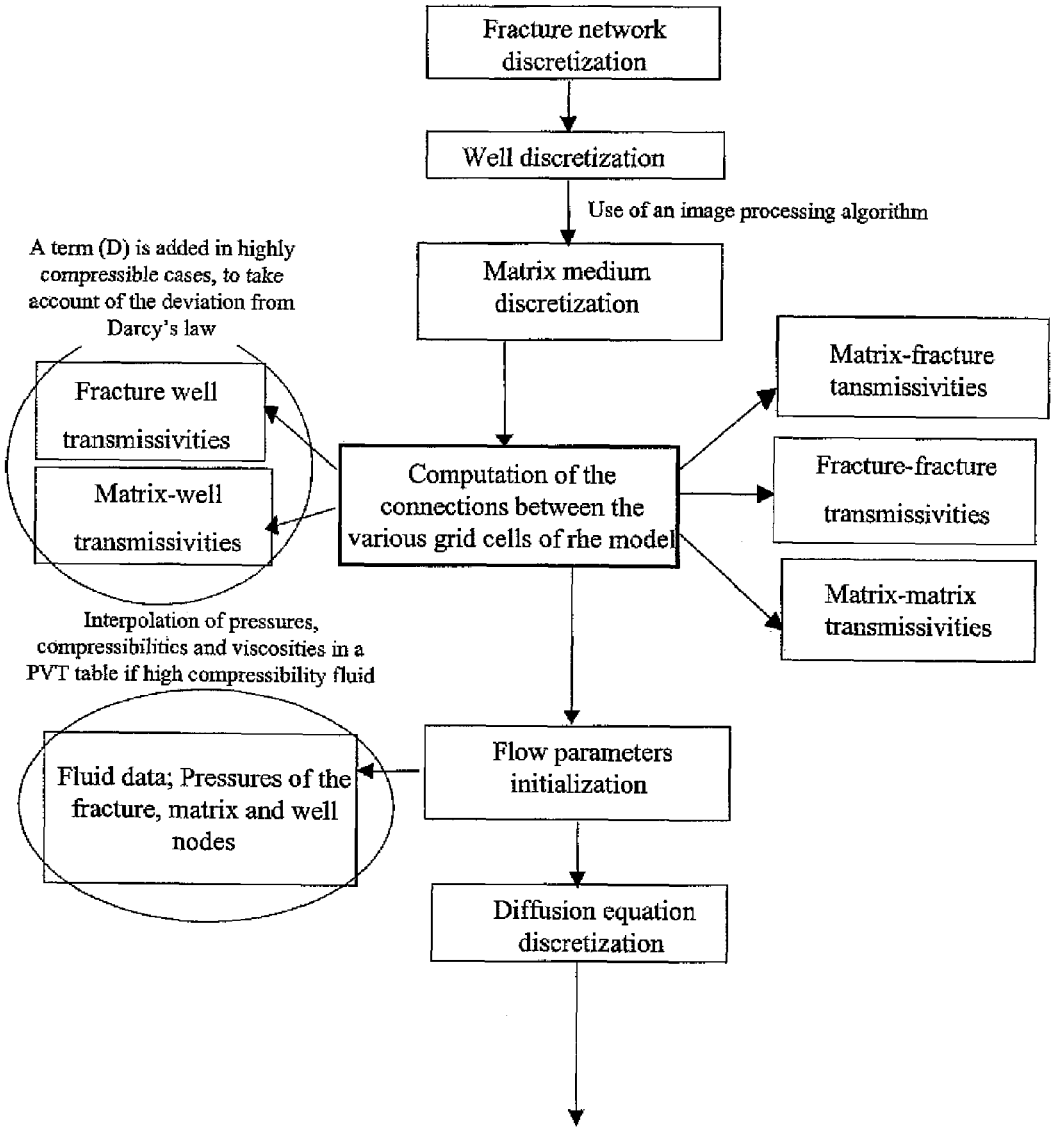
FIG. 9 shows a first part of the flowchart for implementing the modelling method, modified in the case considered where the fluids are highly compressible.
Figure 10:
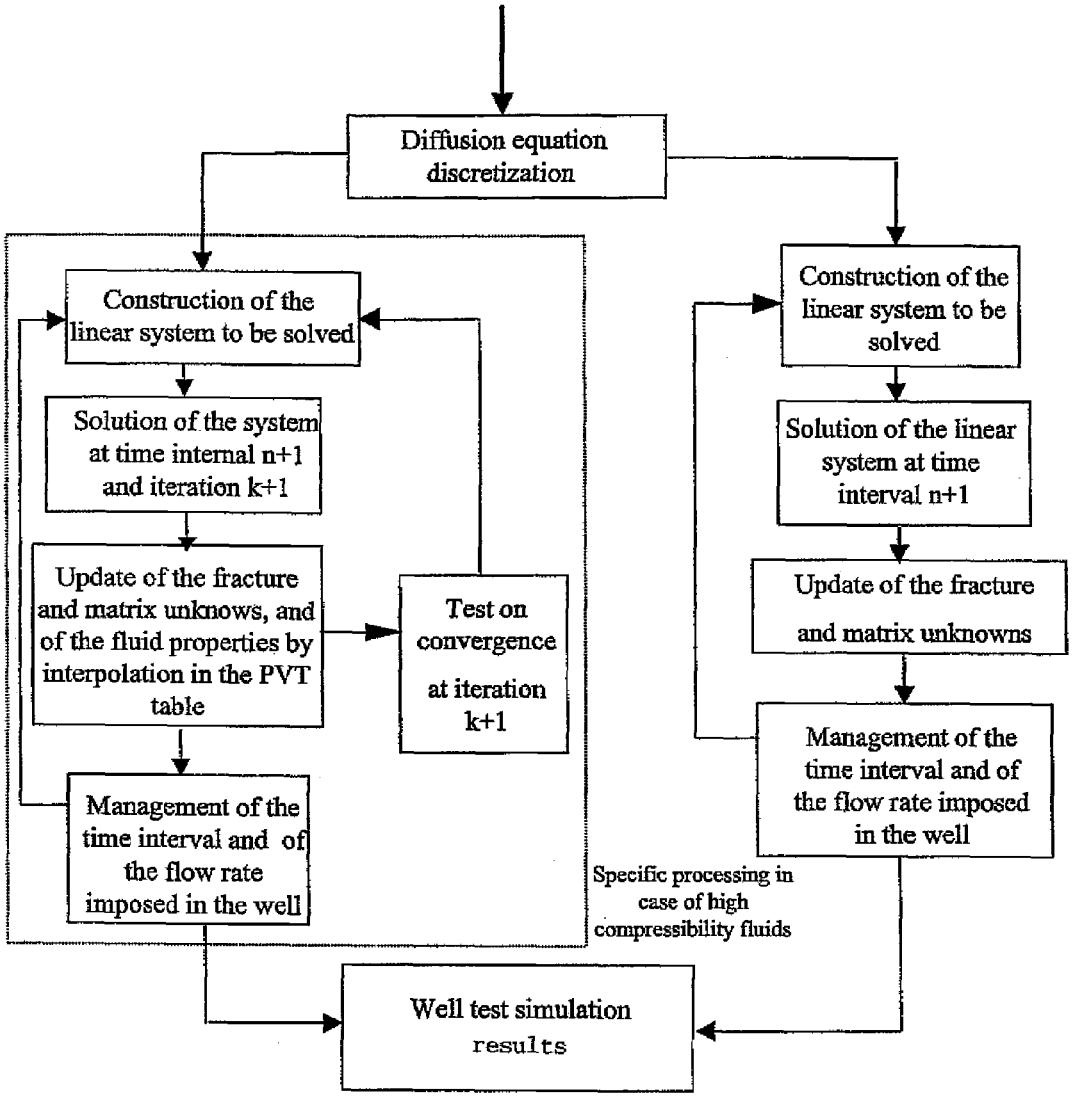
FIG. 10 shows a complementary part of the flowchart for implementing the modelling method, modified in the case where the fluids are highly compressible.

The flowchart of FIG. 9 sums up the various modelling stages carried out.

The invention claimed is:

1. A method for modelling compressible fluid flows in a multilayer porous medium crossed by a network of fractures of given geometry and by a well, comprising the steps:

a) defining, based upon data obtained from the multilayer porous medium, the fractures by a grid pattern comprising fracture grid cells that are centered on nodes either at fracture intersections or at fracture ends, each node being associated with a matrix volume including all points that are closer thereto than to neighboring nodes by using a first image processing algorithm;

b) calculating local flows between each fracture grid cell and an associated matrix volume in a pseudosteady state, a transmissivity value being obtained by considering a linear variation of pressure as a function of distance between any point of the matrix volume and the fracture grid cell computed from the first algorithm and a second image processing algorithm;

c) determining direct flows between the fracture grid cells;

d) determining direct flows between the matrix volumes through the common edges of the grid cells;

e) determining direct flows between the fracture grid cells and the matrix grid cells on one hand, and a volume of the well on another hand; and f) simulating a response of the well for imposed flow rate variations by a diffusion equation connecting interactions between observable pressure and flow rate variations of the well.

2. A method as claimed in claim 1 wherein, the fluid is compressible and the direct flows are determined from transmissivity values suited to turbulent flows and the response of the well is simulated for imposed flow rate variations by means of a modified diffusion equation accounting for compressibility of the fluid.

3. A method as claimed in claim 2, wherein the diffusion equation is modified by introducing a term depending on pressure, viscosity and a compressibility factor of the compressible fluid.

4. A method as claimed in claim 2, wherein the diffusion equation is modified by introducing a pseudopressure accounting for a viscosity and a compressibility variation of the fluids as a function of the pressure.

5. A method as claimed in claim 2, wherein the direct flows are determined by introducing a term derived from Darcy's law proportional to an imposed fluid flow rate, which expresses local pressure drop in a vicinity of the well linked by a flowing velocity of the fluids.

6. A method as claimed in claim 1, wherein the matrix volume associated with each fracture grid cell is determined by defining each fractured layer in a set of pixels and by calculating a distance from each pixel to the closest fracture grid cell to determine a location of edges between the grid cells, and the calculated distances are used to deduce value of the transmissivities between each fracture grid cell and an associated matrix volume on one hand, and between common edges of the grid cells on another hand.

7. A method as claimed in claim 6, wherein a position of the edges between the grid cells is located by displacing two elongate windows in an image formed by the pixels which are oriented in two perpendicular directions.

8. A method as claimed in claim 3, wherein the diffusion equation is modified by introducing a pseudopressure accounting for a viscosity and a compressibility variation of the fluids as a function of the pressure.

9. A method as claimed in claim 3, wherein the direct flows are determined by introducing a term derived from Darcy's law proportional to an imposed fluid flow rate which expresses local pressure drop in a vicinity of the well linked by a flowing velocity of the fluids.

10. A method as claimed in claim 4, wherein the direct flows are determined by introducing a term derived from Darcy's law proportional to an imposed fluid flow rate which expresses local pressure drop in a vicinity of the well linked by a flowing velocity of the fluids.

11. A method as claimed in claim 8, wherein the direct flows are determined by introducing a term derived from Darcy's law proportional to an imposed fluid flow rate which expresses local pressure drop in a vicinity of the well linked by a flowing velocity of the fluids.

12. A method as claimed in claim 2, wherein the matrix volume associated with each fracture grid cell is determined by defining each fractured layer in a set of pixels and by calculating a distance from each pixel to the closest fracture grid cell to determine a location of edges between the grid cells, and the calculated distances are used to deduce value of the transmissivities between each fracture grid cell and an associated matrix volume on one hand, and between common edges of the grid cells on another hand.

13. A method as claimed in claim 3, wherein the matrix volume associated with each fracture grid cell is determined by defining each fractured layer in a set of pixels and by calculating a distance from each pixel to the closest fracture grid cell to determine a location of edges between the grid cells, and the calculated distances are used to deduce value of the transmissivities between each fracture grid cell and an associated matrix volume on one hand, and between common edges of the grid cells on another hand.

14. A method as claimed in claim 4, wherein the matrix volume associated with each fracture grid cell is determined by defining each fractured layer in a set of pixels and by calculating a distance from each pixel to the closest fracture grid cell to determine a location of edges between the grid cells, and the calculated distances are used to deduce value of the transmissivities between each fracture grid cell and an associated matrix volume on one hand, and between common edges of the grid cells on another hand.

15. A method as claimed in claim 5, wherein the matrix volume associated with each fracture grid cell is determined by defining each fractured layer in a set of pixels and by calculating a distance from each pixel to the closest fracture grid cell to determine a location of edges between the grid cells, and the calculated distances are used to deduce value of the transmissivities between each fracture grid cell and an associated matrix volume on one hand, and between common edges of the grid cells on another hand.

16. A method as claimed in claim 8, wherein the matrix volume associated with each fracture grid cell is determined by defining each fractured layer in a set of pixels and by calculating a distance from each pixel to the closest fracture grid cell to determine a location of edges between the grid cells, and the calculated distances are used to deduce value of the transmissivities between each fracture grid cell and an associated matrix volume on one hand, and between common edges of the grid cells on another hand.

17. A method as claimed in claim 9, wherein the matrix volume associated with each fracture grid cell is determined by defining each fractured layer in a set of pixels and by calculating a distance from each pixel to the closest fracture grid cell to determine a location of edges between the grid cells, and the calculated distances are used to deduce value of the transmissivities between each fracture grid cell and an associated matrix volume on one hand, and between common edges of the grid cells on another hand.

18. A method as claimed in claim 10, wherein the matrix volume associated with each fracture grid cell is determined by defining each fractured layer in a set of pixels and by calculating a distance from each pixel to the closest fracture grid cell to determine a location of edges between the grid cells, and the calculated distances are used to deduce value of the transmissivities between each fracture grid cell and an associated matrix volume on one hand, and between common edges of the grid cells on another hand.

19. A method as claimed in claim 11, wherein the matrix volume associated with each fracture grid cell is determined by defining each fractured layer in a set of pixels and by calculating a distance from each pixel to the closest fracture grid cell to determine a location of edges between the grid cells, and the calculated distances are used to deduce value of the transmissivities between each fracture grid cell and an associated matrix volume on one hand, and between common edges of the grid cells on another hand.

20. A method as claimed in claim 12, wherein a position of the edges between the grid cells is located by displacing two elongate windows in an image formed by the pixels which are oriented in two perpendicular directions.

21. A method as claimed in claim 13, wherein a position of the edges between the grid cells is located by displacing two elongate windows in an image formed by the pixels which are oriented in two perpendicular directions.

22. A method as claimed in claim 14, wherein a position of the edges between the grid cells is located by displacing two elongate windows in an image formed by the pixels which are oriented in two perpendicular directions.

23. A method as claimed in claim 15, wherein a position of the edges between the grid cells is located by displacing two elongate windows in an image formed by the pixels which are oriented in two perpendicular directions.

24. A method as claimed in claim 16, wherein a position of the edges between the grid cells is located by displacing two elongate windows in an image formed by the pixels which are oriented in two perpendicular directions.

25. A method as claimed in claim 17, wherein a position of the edges between the grid cells is located by displacing two elongate windows in an image formed by the pixels which are oriented in two perpendicular directions.

26. A method as claimed in claim 18, wherein a position of the edges between the grid cells is located by displacing two elongate windows in an image formed by the pixels which are oriented in two perpendicular directions.

27. A method as claimed in claim 19, wherein a position of the edges between the grid cells is located by displacing two elongate windows in an image formed by the pixels which are oriented in two perpendicular directions.

* * * * *